US005281153A

United States Patent [19]

Smerz

[11] Patent Number: 5,281,153

[45] Date of Patent: Jan. 25, 1994

[54] ALL PURPOSE SOCKET DISC FOR USE IN LIGHTING FIXTURES AND THEIR ASSEMBLY

[75] Inventor: Frank Smerz, Addison, Ill.

[73] Assignee: Cooper Industries, Inc., Houston, Tex.

[21] Appl. No.: 821,360

[22] Filed: Jan. 15, 1992

[51] Int. Cl.[5] ..... H01R 4/66

[52] U.S. Cl. ..... 439/97; 439/615

[58] Field of Search ..... 439/541-543, 439/702-707, 226, 227, 97, 95, 611-619

[56] References Cited

U.S. PATENT DOCUMENTS

| | | | |
|---|---|---|---|
| 1,175,528 | 3/1916 | Keefe | 439/704 |
| 1,740,956 | 12/1929 | Phillips | 439/542 |
| 1,778,684 | 10/1930 | Nero | 439/543 |
| 2,567,686 | 9/1951 | Benander | 439/542 |
| 4,079,244 | 3/1978 | Bortolizzi | 439/541 |

FOREIGN PATENT DOCUMENTS

| | | | |
|---|---|---|---|
| 1342719 | 1/1974 | United Kingdom | 439/702 |

*Primary Examiner*—David L. Pirlot
*Attorney, Agent, or Firm*—Laff, Whitesel, Conte & Saret

[57] ABSTRACT

An all purpose socket disc for use in lighting fixtures and their assembly, each disc including a planar insulating member having a central aperture and a radially offset pin extending outwardly from one surface thereof adapted for cooperation with a bore in a lamp socket. An axially thick head grommet spacer means with an integral thin-walled tubular rivet projecting coaxially from a bore through the spacer and adapted to be secured through the central aperture of the planar member with said spacer extending in the opposite direction from said offset pin. The head also having means on at least one face thereof for preventing rotation relative to said disc and said lighting fixture said means insuring a positive ground with the lighting fixture. The spacer means and the diametral extent of said disc being capable of engaging the interior of said housing at radially spaced points to reinforce said housing and prevent dimpling or clacker effect on said housing when said socket and disc are assembled by screw means to said housing.

19 Claims, 1 Drawing Sheet

ALL PURPOSE SOCKET DISC FOR USE IN LIGHTING FIXTURES AND THEIR ASSEMBLY

This invention relates to the assembly of lampholder housings, also known as light sockets, in assembled relation to lighting fixtures.

BACKGROUND OF THE INVENTION

A common method of assembly of incandescent lighting fixtures is to provide an insulated lampholder housing having suitable internal conductive means for accepting a complimentary lower end of a lamp in such a stable fashion as will support the lamp and provide a source of electrical energy for the energizing of the lamp and thereby providing light. Such insulated lampholder housings, hereinafter referred to as sockets, in the normal household have metallic means for engaging the helical threads on the lower extremity of the lamp, plus, a centrally located generally spring loaded contact for engagement with a central metallic contact on the end of the lamp and insulated from said helical threads. Other configurations such as slot and pin locking means, i.e. bayonet receptacles, are also utilized.

Such light sockets are also provided with secondary fastening means, such as nuts or threaded stems, both solid and hollow, for accepting fasteners introduced from the exterior of or integral with the lighting fixture for securing the insulated housing relative to the interior of the lighting fixture and usually with the fastener serving as a grounding means. In most instances such fasteners are screw threaded members that are coaxial with the helical threads of the socket and lamp. Often over extended usage the fasteners become loosened during the relamping procedures. This results in a deleterious situation wherein the socket and lamp are loose and wobbly relative to the light fixture and can result in overheating of the light fixture, short-circuiting due to damage to insulation and wiring, general deterioration of reflective qualities of the light fixture due to mispositioning of the lamp, and elimination of ability to properly seat the lamp relative to the socket contacts during relamping, as well the possibility of destroying the grounding capability of the fastener.

SUMMARY OF THE INVENTION

This invention overcomes the objectionable features of the prior method of assembly by the introduction of an all purpose socket disc into the assembly.

An object of the present invention is to provide an insulated disc member that is positioned between a lamp socket and the lighting fixture housing that will add additional insulation and substantially prevent rotation between the socket and housing.

A further object is to provide a member that aids in the assembly of the lighting fixture with its components.

Another object is to insure that the socket will remain fixed in the desired location to insure ease and stability during the function of relamping the lighting fixture, i.e. replacement of a burned out bulb. The insulated disc member also includes a metallic spacer grommet that includes an integral tubular rivet portion that is coaxially inserted through a central aperture in the insulated disc and peened over into retaining relation to one surface of the disc while the enlarged head portion of the grommet serves as an electrically conductive grounding spacer between said lamp socket and the lighting fixture that spaces and supports the central portion of the disc from the curved portion of the lighting fixture when the connecting screw is tightened.

Still another object of the invention is to provide an economical solution to the problems confronting the designer and manufacturer of such lighting fixtures, while insuring a positive ground between the socket and the lighting fixture.

Other objects will become apparent to the experts in this art upon reading of the specification set forth below.

DETAILED SPECIFICATION

Figure 1:
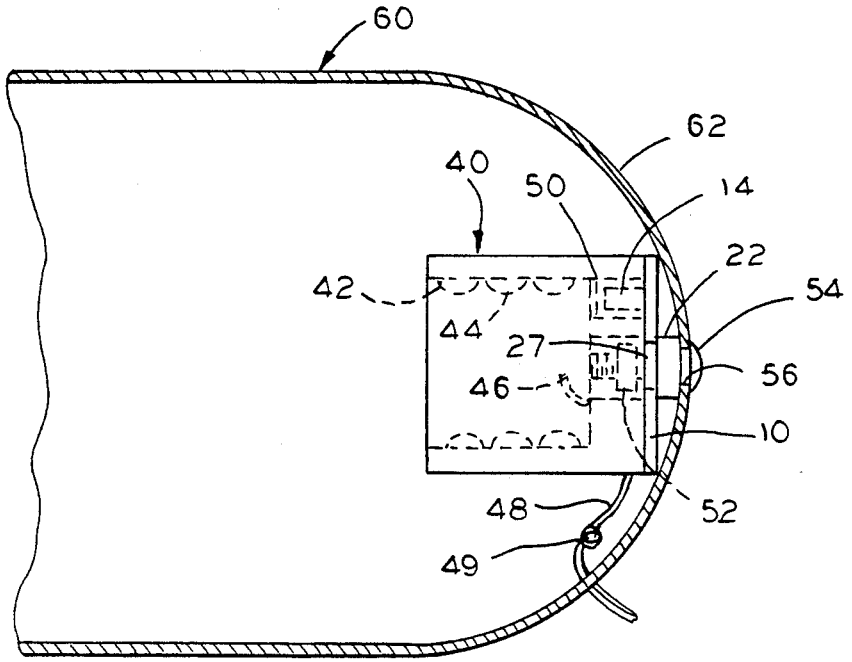
FIG. 1 is a side elevation, in partial section, of a lighting fixture assembly utilizing the present invention.

The lighting fixtures that would benefit the most from this invention include the popular tubular fixture housings utilized with so-called track lighting and other directed lighting types of fixtures having a tubular housing open at one end and closed at the other end by a generated configuration, usually tapered, closed end. Such shapes can include frusto-spherical, frusto-conical, tapered trapezoidal forms, as well as flat butt ends. Such devices are generally deep drawn, or spun, metallic members with the enabling dies being of generated form, as are well known in the art. At least one centrally disposed aperture traverses the end wall of the generated configuration closed end of the fixture and is adapted to accept a screw threaded fastener for fastening the socket to the fixture. The closed ends with which the present invention is utilized are preferably symmetrical about the longitudinal axis of the fixture housing.

The improvement contributed by the present invention resides in the fact that the all purpose socket disc 8 is an assembly of a planar insulated member 10, having a central bore 12 and an integral radially offset protuberance or pin 14 extending from one face of the planar insulated body member 10, and a hollow metallic grommet spacer means 20 non-rotatably mounted on the opposite face around said central bore.

Figure 2:
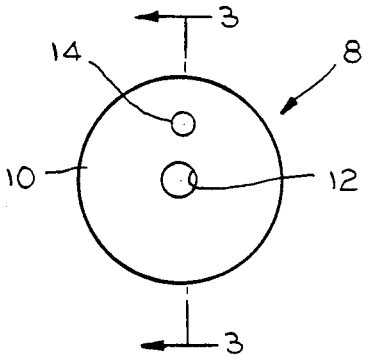
FIG. 2 is a plan view of a preferred embodiment disc of the type contemplated by the present invention.
Figure 3:
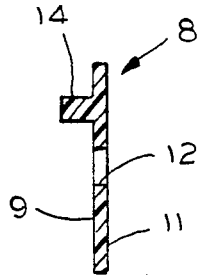
FIG. 3 is a sectional elevation taken along line 3—3 of FIG. 2.

In FIG. 2 the illustrated preferred embodiment of the socket disc 8, the outside perimeter of the planar insulated body member 10 is circular in configuration adapting it for use in frusto-spherical, frusto-conical and other symmetrical configurations having a substantially constant radial dimension in a specific transverse plane perpendicular to the longitudinal axis.

Figure 7:
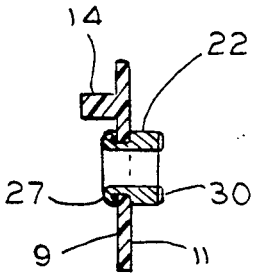
FIG. 7 is a side elevational view, in section, of an insulated disc assembled with a spacer grommet having circumferentially spaced radially ribbed head and with the tubular rivet peened over into connected relation thereto.
Figure 6:
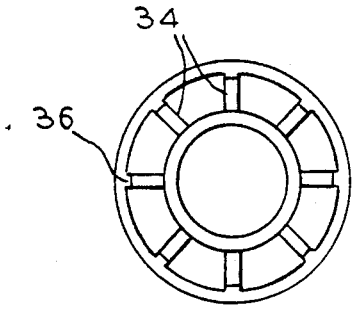
FIG. 6 is an opposite end view taken along line 6—6 of FIG. 4.
Figure 4:
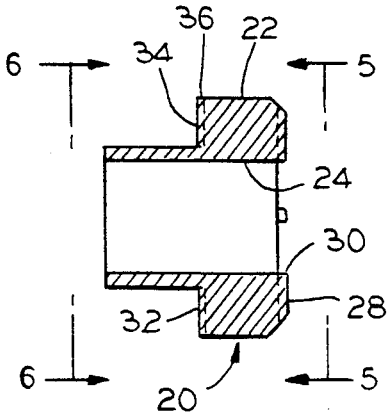
FIG. 4 is an enlarged side elevational view, in section, of one embodiment of a spacer grommet having an enlarged radially ribbed head and an integral tubular rivet extending coaxially therefrom, of the type preferred for use in the present invention.
Figure 5:
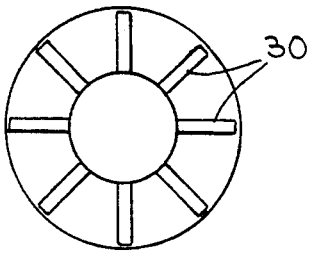
FIG. 5 is a left end view taken along line 5—5 of FIG. 4.

The hollow metallic grommet spacer means 20 includes an enlarged thickened head 22 having a central bore 24 extending axially through head 22 and a thin-walled tubular rivet shank 26 extending coaxially from one face of the head 22. The outer exposed face 28 of head 22 carries a plurality of circumferentially spaced radial ribs or serrations 30, while the underside 32 of head 22 carries a plurality of circumferentially spaced radial ribs or serrations 34 which may, if desired, terminate in a peripheral chamfer 36 that may extend down into the body of the head 22. The shank 26 is introduced through the central bore 12 so that the underside 32 of the head 22 is positioned with the radial ribs 34 in juxtaposed relation to the side 11 of planar body member 10 opposite to the pin 14. The tubular rivet shank 26 is then peened or suitable rolled over radially outwardly into engagement with the pin face 9 in an expanded or peened fashion well known in the rivet art and shown in section and designated 27 in FIG. 7. The serrations or ribs 30 and 34 may be apical in nature and provide radially extending sharp edges for engagement with the disc body 10 and the housing 60. (The spacer means 20 is shown in enlarged form in FIGS. 4–6, but in reality would be configured to be acceptable in bore 12 of body member 10, with the ribs 34 being in interlocked relation to body member 10.)

The insulated socket housing 40 contemplated for use with the present invention has an open ended bore 42 adapted to accept the helical engaging means 44 providing conductive contact with threads of the bulb, not shown, and a secondary conductive means 46 for contacting the end contact of the bulb, as is well known in the art. Suitable power is provided to these conductive means by wiring 48 that is provided egress through the fixture housing 60 and suitably strain relieved, as by the Underwriters knot 49 or other suitable re-entrant strain relief means, not shown. The socket housing 40 includes a radially offset bore 50 adapted to accept the pin 14 for prevention of rotation between the planar body member 10 and the socket 40. Centrally disposed in housing 40 is a rotationally captured nut member 52 adapted to accept the screw 54 extending through central aperture 56 in the fixture housing 60. As can be best seen in FIG. 1, the ribs 30 on the outer face of head 22 are brought into tight engagement with the interior surface of housing 60 to prevent relative rotation therebetween and to insure positive grounding between the socket 40 and the housing 60. The axial thickness of head 22 and the radial dimension of disc 10 is correlated so that disc 10 will be supported and positioned in a transverse plane to the axis of housing 60 so that it is in firm engagement with the interior of the generated shape of closed end 62 at the plane defined by head 22. This distribution of forces to a wide area of the interior of housing 60 ensures that the drawing up of screw 54 will not result in the dimpling or clacker action total flattening of closed end 62 around aperture 56 and the housing 60 will retain its generated shape.

Thus, the socket 40 can be substantially rotationally restrained in its grounded assembly to housing 60 whereby it will not become loosened during the rebulbing operations it will face during its life span.

I claim:

1. A lighting fixture having a lampholder housing, a fixture housing, suitable wiring. and including an all purpose socket disc assembly, said disc assembly including a planar centrally apertured insulated disc for providing a non-rotatable insulation barrier between said lampholder housing and said fixture housing, and tubular unthreaded metallic rivet means non-rotatably mounted in said aperture in said disc for grounding and preventing said lampholder housing from rotating when relamping.

2. A lighting fixture as claimed in claim 1 wherein said fixture housing is generally cup shaped, open at one end and closed at the opposite end, said cup shaped housing including a substantially tubular body and with said closed end being generally non-linear in configuration.

3. A lighting fixture as claimed in claim 2 wherein said closed end is a generated tapered configuration.

4. A lighting fixture as claimed in claim 3 wherein said insulated disc is generally complimentary to an intermediate planar section substantially perpendicular to the axis of said generated configuration.

5. A lighting fixture as claimed in claim 3 wherein said closed end is frusto-spherical in configuration.

6. A lighting fixture as claimed in claim 5 wherein said insulated disc is generally complimentary to an intermediate planar section substantially perpendicular to the axis of said generated configuration.

7. A lighting fixture as claimed in claim 3 wherein said closed end is frusto-spherical in configuration.

8. A lighting fixture as claimed in claim 7 wherein said insulated disc is generally complimentary to an intermediate planar section substantially perpendicular to the axis of said generated configuration.

9. A lighting fixture as claimed in claim 1 wherein said lampholder housing is a light socket including an insulated generally cylindrical housing, metallic means for interlocking with cooperative conductive retaining means on a light bulb, second metallic means for contacting a second contact on said bulb to complete a circuit therewith, complimentary cooperating means on said socket and said disc preventing relative rotation therebetween and means for insuring a positive ground between said socket and said lighting fixture.

10. A lighting fixture as claimed in claim 9 wherein said complimentary cooperating means on said socket and said disc includes an axially extending pin projecting from said disc and a bore in said socket accepting said pin.

11. A lighting fixture as claimed in claim 10 wherein said tubular metallic rivet including an apertured spacer head, said head having a predetermined axial extent, said fixture housing having a centrally disposed aperture in said closed end adapted to accept a socket mounting fastener, said disc having a predetermined diametral extent adapted to contact the interior of said fixture housing in a plane spaced from said aperture a distance substantially equal to said predetermined axial extent of said spacer head, whereby said disc is supported about its periphery on the interior of said housing and at its mid-point by said spacer head acting against said housing adjacent said housing aperture, said disc and housing apertures cooperating with said tubular spacer head to accept headed fastener means extending axially therethrough to fasten said socket means on said disc in non-rotative fashion relative to said housing.

12. A lighting fixture as claimed in claim 11 wherein said tubular metallic rivet is a hollow headed shouldered spacer rivet affixed to said disc through its central aperture, said spacer head rivet including serrations that non-rotatively fasten said rivet to said disc.

13. A lighting fixture as claimed in claim 12 wherein said rivet also includes additional serrations at its end remote from its fastening to said disc, said additional serrations adapted to contact said lampholder housing adjacent its aperture to insure positive grounding and to prevent rotation between said rivet and its associated disc relative to said fixture housing, said rivet having sufficient internal diameter to freely accept a fastening means engaging said socket.

14. A lighting fixture as claimed in claim 13 wherein said fastening means is a screw threaded means, said spacer head and its associated disc permit the non-rotative fastening of said socket relative to said fixture housing without flattening of said generated configuration when said screw threaded means for mounting the assembly is tightened.

15. A system for assembling rotationally restrained socket means to a cup-like fixture housing having a tubular body open at one end and a generated closed end configuration at the opposite end with a centrally disposed aperture, said socket means including a central screw receiving bore and a radially spaced second bore having a predetermined diameter, an all purpose socket disc having a centrally disposed through bore and a pin having a predetermined diameter fixed thereto and extending axially outwardly from one side of said disc, a hollow tubular member fixed to said socket and extending outwardly from the opposite side of said disc along the axis of said centrally disposed through bore, means to prevent rotation between said tubular member and said disc, the outer perimeter of said disc being complimentary to the generated shape of said closed end in a transverse plane spaced from the axial position of said centrally disposed aperture, said tubular member having an axial length sufficient to extend from said disc to a plane falling in said aperture, whereby said disc and said tubular member providing reinforcement to the generated closed end of said fixture housing when a screw is telescoped through said centrally disposed aperture and draws said central screw receiving bore in said socket against one face of said disc with said pin telescoped into said second bore and said perimeter of said disc is drawn tight in complemental relation to said generated inner surface of said fixture housing, without dishing said generated configuration where said screw bears against same.

16. A system as claimed in claim 15 wherein said means to prevent rotation on said tubular member include a head having radially extending rib means on oppositely facing surfaces thereof for engaging both the surface of said disc and the inner surface of said generated closed end adjacent said central aperture.

17. A system as claimed in claim 16 wherein said tubular member includes a relatively thick spacer head with a predetermined thickness adequate to serve as a spacer means between said disc and said fixture housing, and an axially extending thin-walled tubular portion that is adapted to be telescoped through the centrally disposed through bore in said disc until the spacer head is brought into engagement with one surface of said disc and said tubular portion is then rolled over into riveting engagement with an oppositely facing second surface of said disc.

18. A system as claimed in claim 17 wherein said spacer head is provided with radially disposed circumferentially spaced rib means on the surface thereof adjacent to said tubular portion for positive engagement with said disc when said tubular portion is rolled over in riveted disposition thereto.

19. A system as claimed in claim 18 wherein said spacer head is provided with similar radially disposed circumferentially spaced rib means on the oppositely facing surface thereof for engagement with said generated closed end adjacent said centrally disposed aperture.

* * * * *